US005983442A

United States Patent [19]

Louis et al.

[11] Patent Number: 5,983,442

[45] **Date of Patent: *Nov. 16, 1999**

[54] CARPET EXTRACTOR WITH AUTOMATIC CONVERSION

[75] Inventors: Jeffrey S. Louis, Green; Jerry L. Balzer, North Canton; Edgar A. Maurer; David B. Rennecker, both of Canton; Gregg A. McAllise, North Canton; Jeffery A. Morgan, Cuyahoga Falls; James M. Bednar, North Canton, all of Ohio; Carl Behrend, Chicago; Michael J. Reiter, Bloomingdale, both of Ill.

[73] Assignee: The Hoover Company, North Canton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/870,804

[22] Filed: Jun. 6, 1997

[51] Int. Cl.[6] ..... A47L 7/00

[52] U.S. Cl. ..... 15/320; 15/322; 15/328; 15/334; 15/339; 15/387

[58] Field of Search ..... 15/320, 322, 328, 15/331, 334, 387, 339

[56] References Cited

U.S. PATENT DOCUMENTS

| | | |
|---|---|---|
| Re. 32,257 | 10/1986 | Dyson . |
| D. 309,203 | 7/1990 | Goodrich . |
| 1,217,817 | 2/1917 | Peters . |
| 1,539,843 | 6/1925 | Hume . |
| 1,542,262 | 6/1925 | Morton, Jr. . |
| 1,884,868 | 10/1932 | Replogle . |
| 1,936,761 | 11/1933 | Hoover . |
| 1,953,944 | 4/1934 | Becker . |
| 2,046,684 | 7/1936 | Hoover . |
| 2,070,689 | 2/1937 | Smellie . |
| 2,107,016 | 2/1938 | Snyder . |
| 2,174,560 | 10/1939 | Becker . |
| 2,218,035 | 10/1940 | Benson . |
| 2,287,922 | 6/1942 | White . |
| 2,372,033 | 3/1945 | Taylor . |
| 2,720,186 | 10/1955 | Springer . |
| 2,747,215 | 5/1956 | Segesman . |
| 3,253,295 | 5/1966 | Waters . |
| 3,300,806 | 1/1967 | Ripple . |
| 3,438,081 | 4/1969 | Ruzzier . |
| 3,587,515 | 6/1971 | Anderson . |
| 4,334,337 | 6/1982 | Miller et al. . |
| 4,376,322 | 3/1983 | Lockhart et al. . |
| 4,392,271 | 7/1983 | Sepke . |
| 4,571,772 | 2/1986 | Dyson . |
| 4,573,236 | 3/1986 | Dyson . |
| 4,614,003 | 9/1986 | Martin . |
| 4,809,397 | 3/1989 | Jacobs et al. ..... 15/320 |
| 4,811,450 | 3/1989 | Steadings . |
| 5,008,973 | 4/1991 | Worwag . |

(List continued on next page.)

FOREIGN PATENT DOCUMENTS

| | | |
|---|---|---|
| 470731 | 8/1937 | United Kingdom . |
| 2309157 | 7/1997 | United Kingdom . |

*Primary Examiner*—Chris K. Moore
*Attorney, Agent, or Firm*—A. B. Lowe; B. P. Watson

[57] ABSTRACT

An improved carpet extractor is provided having powered brushes for scrubbing cleaning solution on a floor surface and a floor nozzle for extracting soiled cleaning solution from the floor surface in a floor cleaning mode. The extractor may be converted from the floor cleaning mode to an above the floor cleaning mode for cleaning upholstery, stairs, spots on carpet, or the like, with an attached hand held wand having a cleaning solution applicator and an upholstery and stair cleaning nozzle. A pair of motors are provided, one for driving the floor scrubbing brushes when in the floor cleaning mode and one for driving a cleaning solution supply pump and providing pressurized cleaning solution to the wand in the above floor cleaning mode. An automatic conversion mechanism is provided for automatically energizing and de-energizing the motors depending upon the operative position of the handle portion of the extractor.

58 Claims, 9 Drawing Sheets

U.S. PATENT DOCUMENTS 5,168,599 12/1992 Williams .
5,222,276 6/1993 Glenn, III .
5,243,734 9/1993 Maurer et al. .
5,247,720 9/1993 Sovis et al. .
5,293,665 3/1994 Worwag .
5,345,650 9/1994 Downham et al. .
5,351,361 10/1994 Buchtel .
5,355,549 10/1994 Steinberg et al. .
5,373,598 12/1994 Weber et al. .
5,416,948 5/1995 Worwag .
5,467,501 11/1995 Sepke .
5,477,586 12/1995 Jacobs et al. .
5,493,752 2/1996 Crouser et al. ..... 15/334 X
5,551,120 9/1996 Cipolla et al. .
5,560,074 10/1996 Graham et al. .
5,615,448 4/1997 Crouser et al. ..... 15/334 X
5,715,566 2/1998 Weaver et al. ..... 15/320
5,784,755 7/1998 Karr et al. ..... 15/334

CARPET EXTRACTOR WITH AUTOMATIC CONVERSION

FIELD OF THE INVENTION

The present invention relates to a carpet extractor, and more particularly to an upright carpet extractor having powered scrub brushes and a floor nozzle for cleaning a carpet, an attached hose with a hand held spray and suction tool for above floor cleaning, and a mechanism for automatically converting the extractor from floor cleaning mode to above floor cleaning mode, depending upon the position of the extractor's handle.

BACKGROUND OF THE INVENTION

In the prior art, it is known to provide carpet extractors with a hand held wand having a cleaning solution applicator and suction nozzle attached to a flexible suction hose that is permanently attached or attachable to the extractor for above floor cleaning. Such an arrangement provides for convenient above floor cleaning of upholstery, stairs and the like and for convenient cleaning of small spots on carpeting with the hand held wand.

In existing extractors having a selectively attachable suction hose and hand held wand, the end of the suction hose commonly has a convertor on the end of the hose for attaching the suction hose to the extractor. In some existing extractors a removable element, such as a removable floor nozzle or a removable section of suction duct, is removed from the extractor and the convertor on the suction hose is attached to the extractor in place of the removable element. In other existing extractors, the convertor is inserted into a port in the suction duct into fluid communication with the suction duct. In either case, when the convertor is attached to the extractor, suction is diverted from the extractor's floor nozzle to the suction hose and hand held wand for above floor cleaning. It is also known to simply attach a converter to the floor nozzle itself, such that the floor nozzle draws air through the suction hose for above floor cleaning.

In existing extractors with a permanently attached hose and hand held wand, it is typically necessary to manually activate a valve in the suction line via a lever, knob, or the like, in order to divert the suction from the floor nozzle to the suction hose for above floor cleaning.

SUMMARY OF THE INVENTION

It is an object of the present invention to provide an upright carpet extractor with automatic conversion from floor cleaning mode to above floor cleaning mode, without the operator having to insert hoses into the extractor, replace parts of the extractor or manually activate any levers or the like.

A further object of the present invention is to provide such an upright carpet extractor having automatic conversion with a hand held wand having a cleaning solution applicator and a suction nozzle, which wand is preferably permanently attached to the extractor via a flexible suction hose and solution supply tube for above floor cleaning.

Another object of the present invention is to provide such an extractor having automatic conversion with a hand held wand and a cleaning solution supply pump that is automatically actuated to deliver cleaning solution to the hand held wand in the above floor cleaning mode.

A further object of the present invention is to provide such an extractor having automatic conversion with a powered agitator for scrubbing a floor surface that is automatically energized in a floor cleaning mode and automatically de-energized in an above floor cleaning mode.

In a carpet extractor having powered brushes for scrubbing the surface being cleaned, it is undesirable to power the brushes by electrical means, such as an electric motor, because of the general presence of liquids in the vicinity. Therefore, it is a secondary object of the invention to provide an extractor suitable for scrubbing carpeted and/or bare floors without the use of electrically powered brushes. Although, it can be appreciated that with proper safeguards, electrical means may be used to drive the brushes. As such, the invention is intended to include an extractor with electrically driven, as well as non-electrically driven brushes.

The foregoing objectives, and other objectives that will be readily apparent from the following description and the attached drawings, are achieved by one preferred embodiment of the present invention by providing an extractor that preferably employs dual air driven turbines, one for driving an agitator in the form of floor scrubbing brushes when used in the floor cleaning mode and a second for driving a cleaning solution supply pump when used in the above floor cleaning mode.

In one form of the present invention, a unique automatic conversion mechanism is provided whereby the brush drive turbine and the pump drive turbine are automatically energized or de-energized depending on the position of the extractor's handle. When the handle is inclined to its operating position for floor cleaning, the conversion mechanism automatically actuates the elements of the extractor to place the extractor in the floor cleaning mode. Likewise, when the handle is placed in its generally upright storage position, the conversion mechanism automatically actuates the elements of the extractor to place the extractor in the above floor cleaning mode.

In the disclosed form of the present invention, in the floor cleaning mode, the suction is directed through the floor nozzle, the brush drive is energized and the pump drive is de-energized by the conversion mechanism. When in the above floor cleaning mode, the suction is directed through the hand held suction tool, the pump drive is energized and the brush drive de-energized by the conversion mechanism.

In another form of the present invention, a manual override mechanism is provided whereby the operator may manually de-energize the brush drive in the floor cleaning mode to pick up spills without scrubbing and/or select an intermediate speed for the powered brushes if desired.

DETAILED DESCRIPTION OF THE INVENTION

Figure 1:
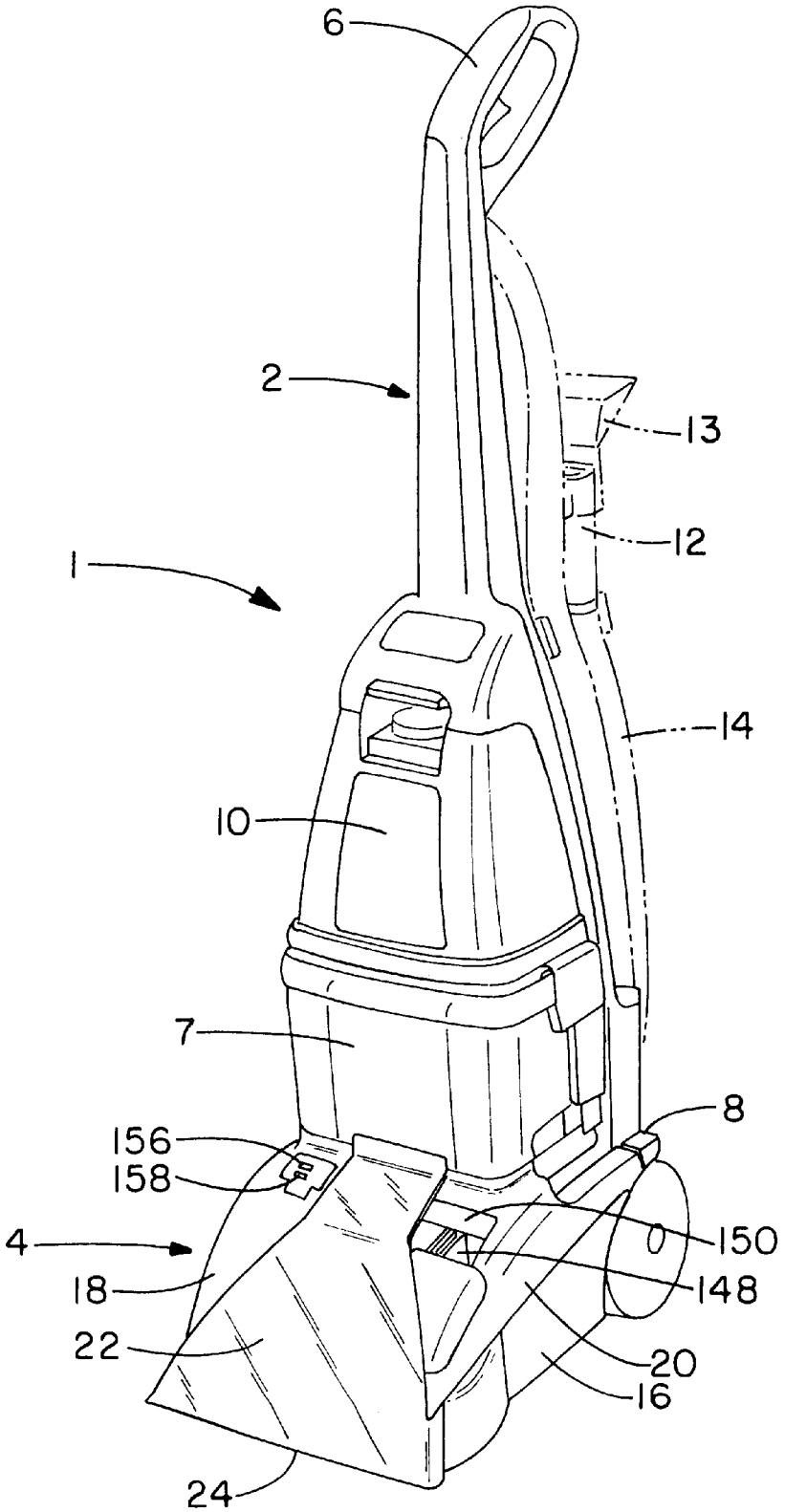
FIG. 1 is a pictorial, perspective view of an upright carpet extractor embodying the present invention.

Referring now to FIG. 1, according to one preferred embodiment of the present invention, an upright carpet extractor 1 is provided with automatic conversion from a floor cleaning mode to an above floor cleaning mode. The carpet extractor 1 comprises a generally upright handle portion 2 pivotally attached to a base module or floor engaging section 4. The handle portion 2 includes a hand grip 6 for propelling the extractor over a floor surface. The handle portion is pivotal from a generally upright, locked storage position (as illustrated in FIG. 1), through an inclined operating position, and to a generally horizontal recovery tank 7 removal position. A conventional foot actuated handle release lever 8 is provided for unlocking the handle 2 when it is desired to move the handle from the locked storage position. A cleaning solution supply tank 10 is releasably mounted to the handle portion 2 as disclosed in commonly owned U.S. Pat. No. 5,406,673 entitled Tank Carry Handle and Securement Latch issued on Apr. 18, 1995, the description of which is hereby incorporated herein as of reference. The structural details and operation of the cleaning solution supply tank do not form a part of the present invention and are therefore not described in detail herein.

For above floor cleaning of stairs, upholstery, small spills, spots and the like, and for cleaning spots on carpeting, a hand held spray and suction wand 12 is permanently attached to the handle portion 2 by a flexible suction hose 14. The hand held wand 12 is conveniently releasably mounted to the handle portion 2 for ready access and storage. The hand held wand 12 has a trigger valve (not shown) operated cleaning solution applicator (not shown) and an above floor or upholstery extractor nozzle 13 mounted thereto. A flexible cleaning solution supply tube (44 in FIG. 3) is preferably threaded through the flexible suction hose 14 and fluidly connects the trigger valve (not shown) on the hand held wand to a cleaning solution pump (discussed in further detail hereinafter) located in the base module 4. The suction hose 14 and the supply tube 44 preferably pass through a lower side of the handle portion 2 and are connected to the cleaning solution pump and a suction duct that are mounted on the base module, as discussed in further detail below.

The structural details and operation of the hand held spray and suction wand 12 do not form a part of the present invention and are therefore not described in detail herein. However, a hand held spray and suction wand suitable for use with the carpet extractor 1 is disclosed in commonly owned U.S. patent application Ser. No. 08/642,788 entitled Compact Carpet Extractor, filed on May 3, 1996, the description of which is hereby incorporated herein as of reference, and in commonly owned U.S. Pat. No. 5,493,752 entitled Upright Carpet and Upholstery Extractor, issued on Feb. 27, 1996, the description of which is hereby incorporated herein as of reference.

The base module 4 comprises a lower housing 16 and a hood or upper housing 18 which separate along a parting line 20. A suction floor nozzle 22 with a suction inlet 24 are part of the upper housing 18. A cleaning solution recovery tank 7 is removably mounted on the base module 4.

The remaining structural details and operation of the handle portion 2 and base module 4 do not form a part of the present invention and are therefore not described in detail herein. However, the general structural arrangement and operation of the handle portion 2 and the base module 4 of upright extractor 1 according to the present invention are similar to those disclosed in co-owned U.S. Pat. No. 5,500,977, entitled "Upright Carpet Extractor", issued on Mar. 26, 1996, the description of which is hereby incorporated herein as of reference.

Figure 2:
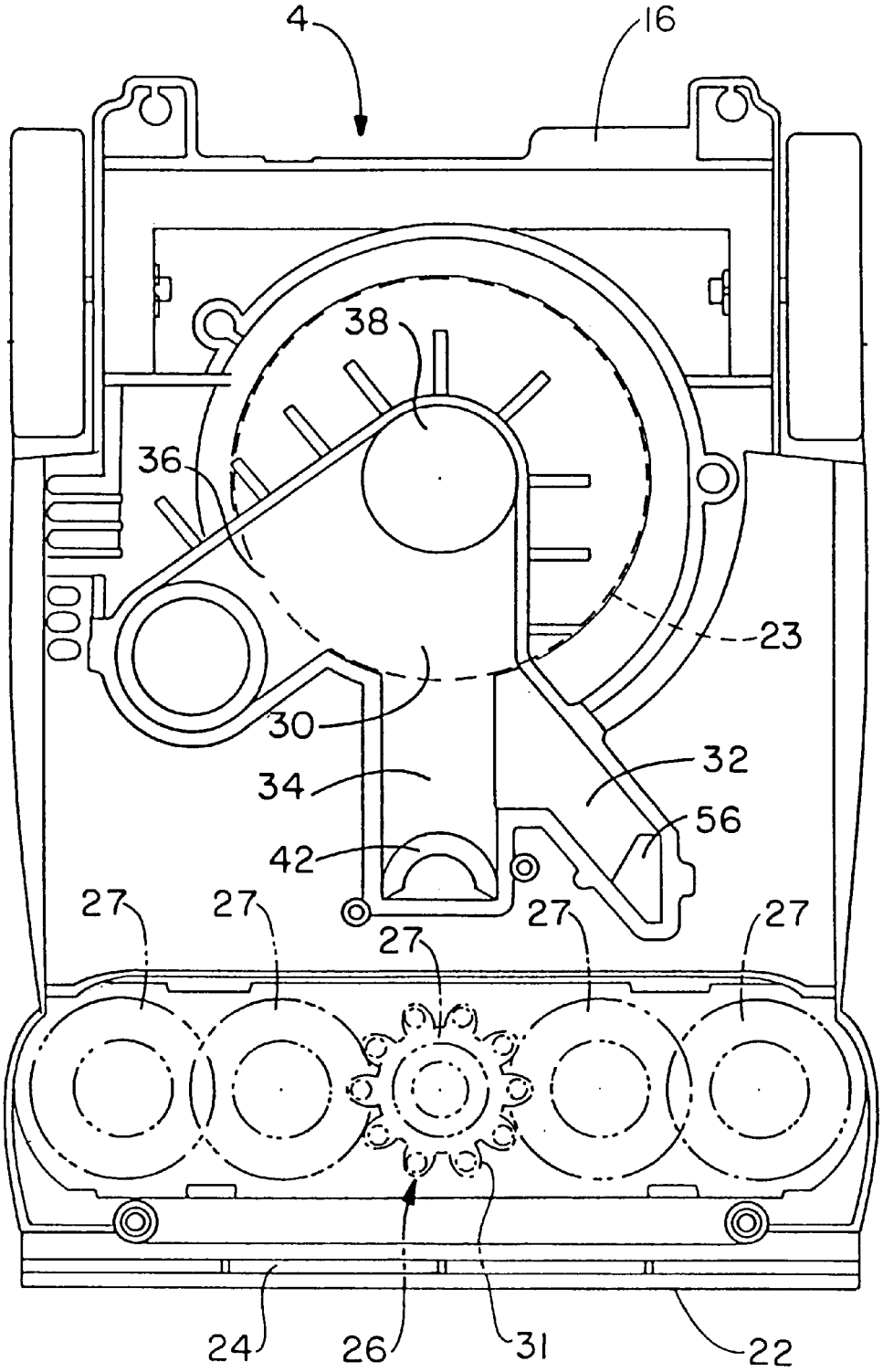
FIG. 2 is a bottom view of the extractor of FIG. 1.

Referring now to FIG. 2, the lower housing 16 generally comprises a molded body (similar to that as taught in the above referenced U.S. Pat. No. 5,500,977) having mounted thereto a conventional electric motor and fan assembly 23 (the outline of which is illustrated in ghost) for providing a working vacuum and air flow for the extractor. Integrally molded into the underside of the lower housing 16 is a vacuum manifold 30 having manifold extensions 32, 34, and 36 fluidly communicating the motor and fan assembly 23 with the other components of the extractor, as discussed in further detail hereinafter. The manifold 30 is completed by a one piece bottom plate, which is not shown in FIG. 2. The bottom plate is not shown in FIG. 2 so that the duct work inside the bottom plate connecting the motor fan assembly with the other components of the extractor can be seen. The motor fan assembly provides suction to the manifold 30 and the manifold extensions 32, 34, 36 through the fan inlet or eye 38. Suction duct 51 extends up from the manifold extension 36 into fluid communication with the recovery tank 7 (shown in FIG. 1). Thus, vacuum is supplied from the motor fan assembly to the solution recovery tank via the vacuum manifold 30 and the manifold extension 36.

A driven floor scrubbing agitator or brush system 26 is mounted to the lower housing adjacent the floor nozzle inlet 24 for scrubbing a floor surface to be cleaned. The brush system 26 preferably comprises five substantially identical vertical axis rotary scrub brushes 27. The outline of the center brush is illustrated in ghost, while the remaining brushes, each having an identical configuration to the center brush, are diagrammatically illustrated in ghost. The outer periphery of each of the brushes 29 define gear teeth 31 that intermesh with the gear teeth on the outer periphery of the adjacent brush or brushes 27. With this construction, all five brushes may be driven by driving just one of the brushes. This construction also causes adjacent brushes to rotate in opposite directions for enhancing the scrubbing action of the brushes on the floor surface. The remaining details of the structure and operation of the brush system 26 do not form a part of the present invention and are not discussed in detail herein. However, a suitable scrubbing brush system is disclosed in co-pending U.S. patent application entitled "Carpet Extractor Brush Assembly", Ser. No. 08/678,496, filed on Jul. 9, 1996, the description of which is hereby incorporated herein as of reference.

Figure 3:
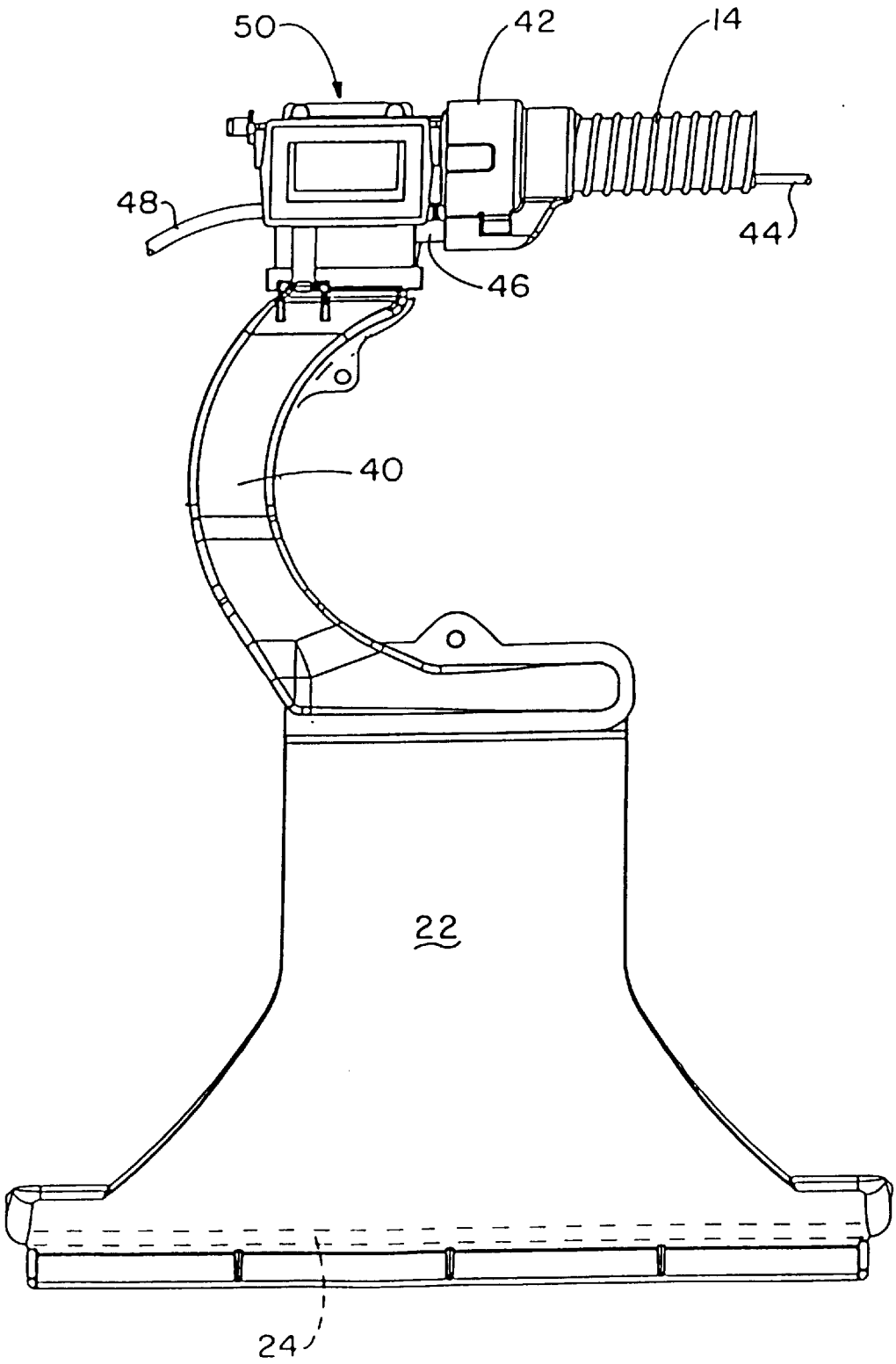
FIG. 3 is an explanatory top plan view of the duct work in the extractor.

Referring now to FIG. 3, the suction inlet 24 of the floor nozzle 22 is connected to the solution recovery tank 7 (shown in FIG. 1) by way of a main suction duct 40. The main suction duct is mounted to the lower housing 16 and extends from the floor nozzle, under the recovery tank 7 and around the motor fan assembly 23 (shown in ghost in FIG. 2), and is connected to a main suction control valve 50, which is likewise mounted to the lower housing. A stand pipe (not shown), that is preferably integrally formed with the recovery tank 7, extends up from the suction control valve (i.e. out of the paper in FIG. 3) into communication with the recovery tank 7 via the recovery tank lid (not shown).

The inner end of the suction hose 14 is connected to the main suction control valve 50 by a hose collar 42. The hose collar may be either attached to or integrally formed on the end of the suction hose 14. The hose collar also connects the cleaning solution supply tube 44 to a fluid discharge nipple 46 mounted to the lower housing 16. The fluid discharge nipple is in fluid communication with the fluid pump 29 by way of flexible tubing 48 or other suitable manner. Gaskets (not shown) are preferably provided between the floor nozzle 22 and the main suction duct 40, between the main suction duct and the main suction control valve 50, and between the main suction control valve and the hose collar 42 to provide a fluid tight seal at each junction.

In operation, the main suction control valve 50 selectively connects the recovery tank 7 (see FIG. 1) to the floor nozzle 22 when in the floor cleaning mode and to the suction hose 14 and the above floor nozzle 13 when in the above floor cleaning mode. Thus, the motor fan assembly 23 draws a suction on the recovery tank 7 (shown in FIG. 1) via the manifold extension 36 and the duct 39 (see FIG. 2), thereby causing air and entrained cleaning liquid and soil to be drawn either in through the floor nozzle inlet 24 in the floor mode or in thorough the hand held upholstery nozzle 13 in the above floor mode and into the recovery tank 7 via the main suction control valve 50. The liquid and soil enter the recovery tank via an air and liquid separator contained in the recovery tank lid (not shown). The liquid and soil are separated from the air while passing through the lid and are recovered in the recovery tank. The separated air is drawn out of the recovery tank by the motor fan assembly via the duct 39 and the manifold extension 36 (see FIG. 2) and exhausted to the external atmosphere. The details and operation of the recovery tank and separator contained in the recovery tank lid do not form a part of the present invention and are therefore not described in detail herein. However, a recovery tank and separator suitable for use with the upright carpet extractor 1 is described in the above mentioned co-owned U.S. Pat. No. 5,500,977, entitled "Upright Carpet Extractor," and in commonly owned, recently filed, U.S. patent application, client docket no. 2476, entitled "Air and Liquid Separator for a Carpet Extractor."

Figure 4:
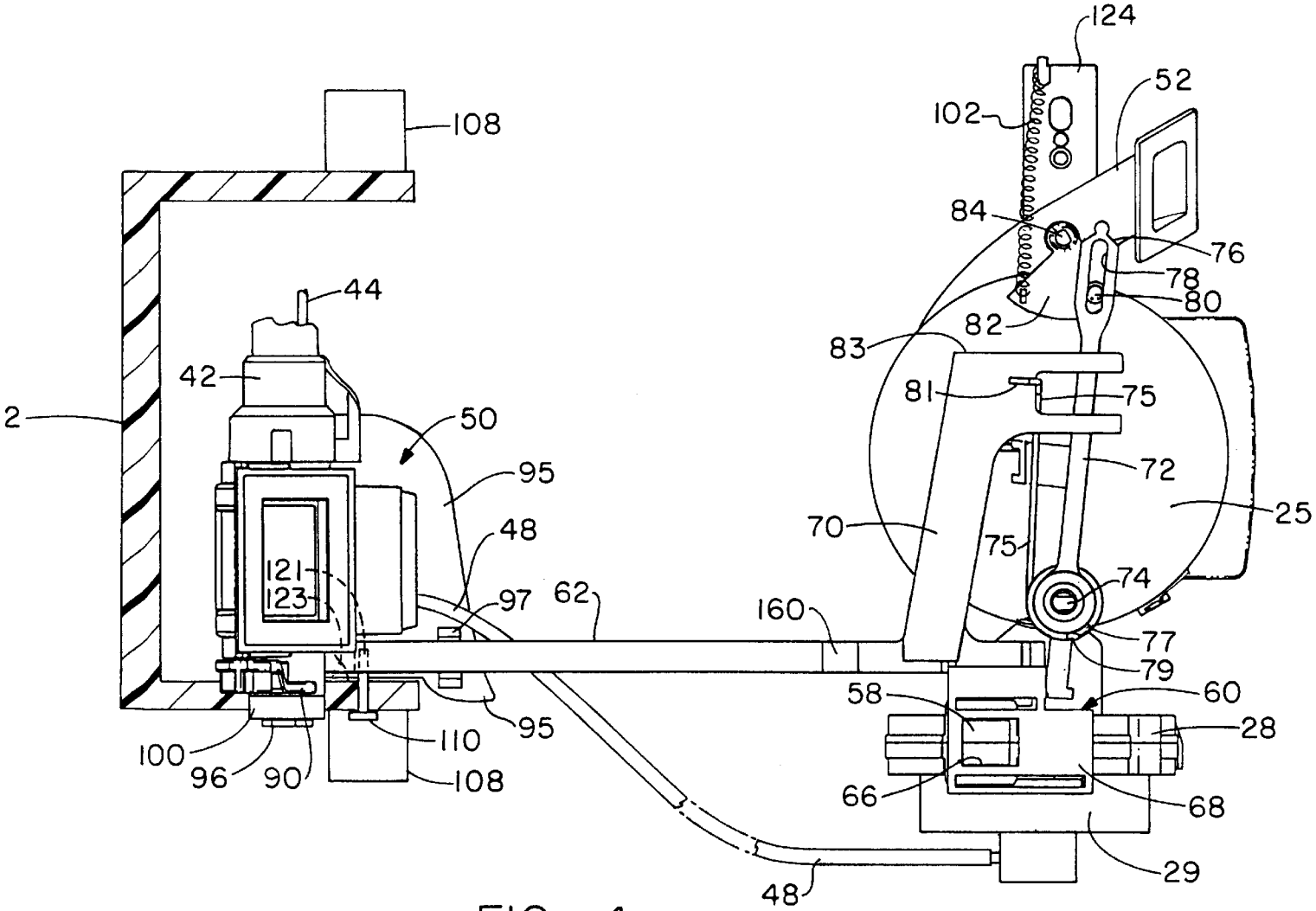
FIGS. 4 and 5 are explanatory top plan views of the automatic conversion mechanism in the above floor cleaning and floor cleaning modes, respectively.

Referring now to FIG. 4, an air driven turbine 25 for providing motive power for the brush system 26 when in the floor cleaning mode, and an air driven turbine 28 for driving a fluid pump 29 (see FIG. 4) and providing a supply of pressurized cleaning solution to the hand held wand 12 when in an above floor cleaning mode are mounted to the lower housing 16 (not shown in FIG. 4). The brush turbine 25 drives the brush system 26 via a suitable gear train (not shown) or other known drive train. The structural details and operation of the brush system, the air turbine and the gear train do not form a part of the present invention and are therefore not described in detail herein. However, a suitable air turbine and gear train is disclosed in co-owned U.S. Pat. No. 5,443,362, entitled "Air Turbine", issued on Aug. 22, 1995 the description of which is hereby incorporated herein as of reference. A suitable air turbine is also disclosed in commonly owned U.S. patent application Ser. No. 08/677,275, entitled "Air Turbine" filed on Jul. 9, 1996, and now abandoned, the description of which is hereby incorporated herein as of reference. Furthermore, the structure and general operation of a suitable air turbine driven fluid pump 29 are fully described in co-owned U.S. Pat. No. 5,500,977 referenced above.

In order to energize the brush turbine 25 and drive the brush system 26 (see FIG. 2), the motor fan assembly 23 (see FIG. 2) draws atmospheric air in through the brush turbine 25 by way of a brush turbine inlet conduit 52. The air then passes through the brush turbine 25 and exits through an exit conduit 42 (see FIG. 2) and the manifold extension 34 to the motor fan assembly 23. Positioned within the brush turbine inlet conduit 52 is a brush turbine throttle valve 54 (see FIGS. 16 through 19) for selectively energizing and de-energizing the brush turbine 25.

In order to energize the pump turbine 28 and drive the pump 29, the motor fan assembly 23 (see FIG. 2) applies suction to an exit conduit 56 (see FIG. 2) of the pump turbine 28 via the manifold extension 32 (see FIG. 2) to draw atmospheric air in through a pump turbine inlet opening 58, through a pump turbine inlet conduit 59 (see FIGS. 5 and 6) and through the pump turbine 28. A slide valve 60 is slidingly mounted to a top of the pump turbine inlet conduit 59 for selectively closing the pump turbine inlet opening and deactivating the fluid pump 29 in the floor cleaning mode and for opening the pump turbine inlet opening and activating the fluid pump in the above floor cleaning mode.

Figures 5, 6:
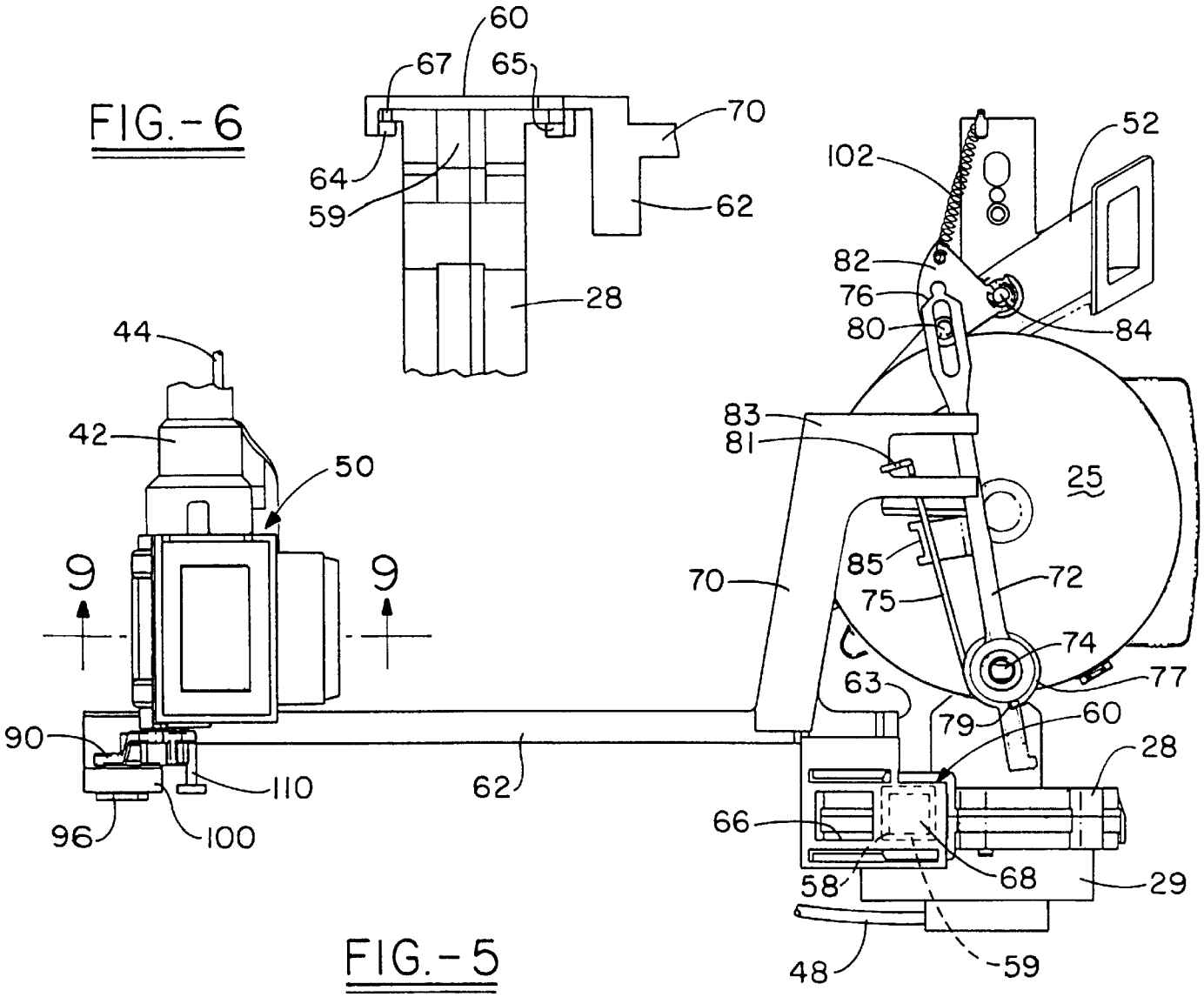
FIG. 6 is an explanatory partial front elevational view of the pump turbine inlet conduit illustrating the slide valve mounting arrangement.
Figure 16:
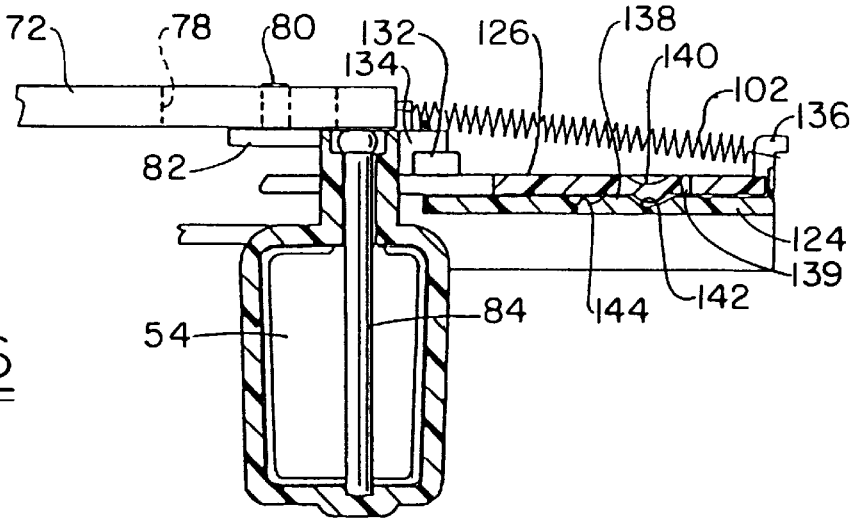
FIG. 16 is a cross-sectional view of the manual override mechanism taken along line 16—16 in FIG. 14.

When the carpet extractor 1 is in the above floor cleaning mode, as shown in FIG. 4, the brush turbine throttle valve 54 is closed (as illustrated in FIG. 16) de-energizing the brush turbine 25, the slide valve 60 is open energizing the pump turbine 28, and the main suction control valve 50 fluidly connects the upholstery nozzle 13 to the solution recovery tank 7. On the other hand, when the carpet extractor is in the floor cleaning mode, as shown in FIG. 5, the brush turbine throttle valve is open energizing the brush turbine, the slide valve is closed de-energizing the pump turbine and the main suction control valve connects the floor nozzle 22 to the recovery tank.

When in the floor cleaning mode, cleaning solution, water or other cleaning liquid is preferably gravity fed from the cleaning solution supply tank 10, through a solution supply tube (not shown), to the brush system 26. The brushes then distributed and scrub the cleaning solution into the carpet or other floor surface being cleaned. The structural details and operation of the fluid distribution to the brushes do not form a part of the present invention and are therefore not described in detail herein. However, a suitable gravity fed fluid distribution system for supplying cleaning solution from the supply tank to the brushes is disclosed in commonly owned U.S. patent application Ser. No. 08/679,453 filed on Jul. 9, 1996, entitled Carpet Extractor Fluid Supply System, the description of which is hereby incorporated herein as of reference. It can be appreciated that, if desired, the fluid pump 29 may also provide pressurized cleaning solution to the brushes or floor when in the floor cleaning mode as an alternative to the previously described gravity feed.

In the interest of energy management, it is desirable that only one of the air turbines 25 and 28 be energized at a time, depending upon the operational mode of the cleaner. When in the floor cleaning mode, only the brush turbine 25 is required to operate and when in the above floor cleaning mode only the pump turbine 28 is required to operate. Operating only one of the turbines at a time maximizes the air flow available for driving the operating turbine and for extraction through the operating one of the floor nozzle 22 or the above floor nozzle 13, and therefore maximizes the available power for driving the brushes or driving the pump, and for extraction. Therefore, a conversion mechanism is preferably provided to close the brush turbine throttle valve 54 when in the above floor cleaning mode and to close the pump turbine slide valve 60 when in the floor cleaning mode.

Still referring to FIG. 4, the conversion mechanism includes an actuating rod 62 that extends from the pump turbine inlet conduit 59 toward the rear of the base module 4 (not shown in FIG. 4). The actuating rod 62 is supported (as discussed in further detail below) for longitudinal reciprocal movement relative the base module 4 between a forward above floor mode position shown in FIG. 4 and a rearward floor mode position shown in FIG. 5. Forward meaning toward the floor nozzle 22 and rearward meaning away from the floor nozzle.

The slide valve 60 is preferably integrally formed on the front end of the actuating rod 62. Front meaning toward the floor nozzle 22. The slide valve is slidably mounted to the top of the pump turbine inlet conduit 59 by L-shaped mounting or guide flanges 64 and 65 projecting down from opposing sides of the slide valve 60 (as best seen in FIG. 6). The guide flanges 64 and 65 extend parallel to a longitudinal axis of the actuating rod 62 and slide over a beaded top edge 67 of the pump turbine inlet conduit 59. In this manner, the forward end of the actuating rod is reciprocally mounted to the top of the pump turbine inlet conduit 59. A window 66 passing through the slide valve is aligned with the turbine inlet opening 58 when actuating rod 62 is in its forward, above floor mode position shown in FIG. 4. When the actuation rod is moved to its rearward, floor mode position shown in FIG. 5, a solid portion 68 of slide valve 60 closes the pump turbine inlet opening 58.

The actuating rod 62 includes a leg 70 that extends at an angle, from a point proximate the front end 63 (see FIG. 5) of the actuating rod, partially across the front of the base module 4 for engagement with a link arm 72. The link arm is pivotally mounted to a pivot post 74 extending up from the brush turbine (as illustrated in FIGS. 4 and 5) or from the lower housing 16. The leg 70 engages the link arm via a torsion spring 75. A first end 77 of the torsion spring 75 is coiled at least once around the pivot post 74 and is hooked 79 to the link arm 72. A second end 81 of the torsion spring hooks on a bifurcated end 83 of the leg 70 of the actuating rod when the actuating rod is moved forward into the above floor mode position.

Figure 17:
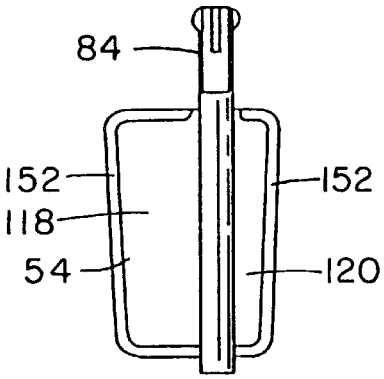
FIGS. 17 and 18 are front and top views, respectively, of the brush turbine throttle valve.
Figure 18:
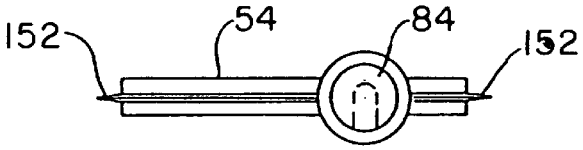

An end 76 of the link arm is provided with a slot 78 which slidingly receives therein a bell pin 80 projecting upward from a bell crank 82 fixed to a rotatable shaft 84 of the brush turbine throttle valve 54 (see FIGS. 16 through 18). The throttle valve 54 is fixed to the rotatable shaft 84 such that rotation of the bell crank rotates the shaft 84 and selectively opens and closes the throttle valve.

When the actuating rod 62 is moved forward from the floor mode position shown in FIG. 5 to the above floor cleaning mode position shown in FIG. 4, the bifurcated end 83 of the leg 70 engages and pushes the second end 81 of the torsion spring forward creating a clockwise torsion force on the torsion spring about the pivot post 74 as viewed in FIG. 4. The torsion force is transferred to the link arm 72 by the first end 77 of the torsion spring where it is hooked 79 on the link arm. Thus, the actuating rod 62 applies a clockwise torsion force about the pivot post 74 on the link arm, via the leg 70 and the torsion spring 75. As a result, when the actuating rod is moved forward to the above floor mode position, the torsion spring causes the link arm to rotate clockwise (as viewed in FIG. 4) about the pivot post 74, from the floor mode position illustrated in FIG. 5 to the above floor mode position illustrated in FIG. 4, thereby rotating the bell crank 82 and closing the brush turbine throttle valve 54. On the other hand, when the actuating rod 62 is moved rearward to the floor cleaning mode position (shown in FIG. 5), a spring 102 assists in returning the bell crank, the brush turbine throttle valve 54 and the link arm 72 to the open position for energizing the brush system 26.

Figure 7:
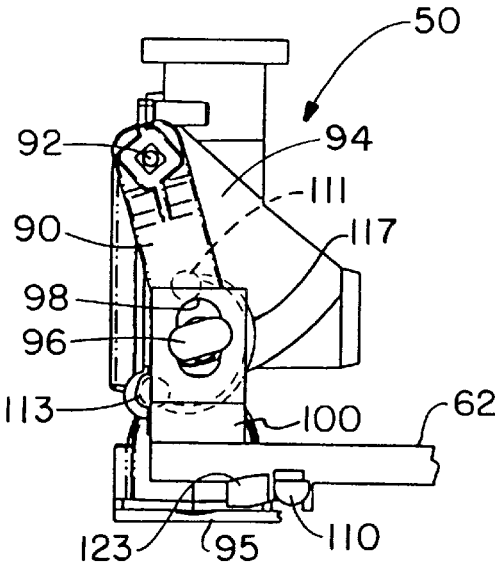
FIGS. 7 and 8 are explanatory partial side elevational views of the main suction control valve and the conversion mechanism in the above floor and floor cleaning modes, respectively.
Figure 8:
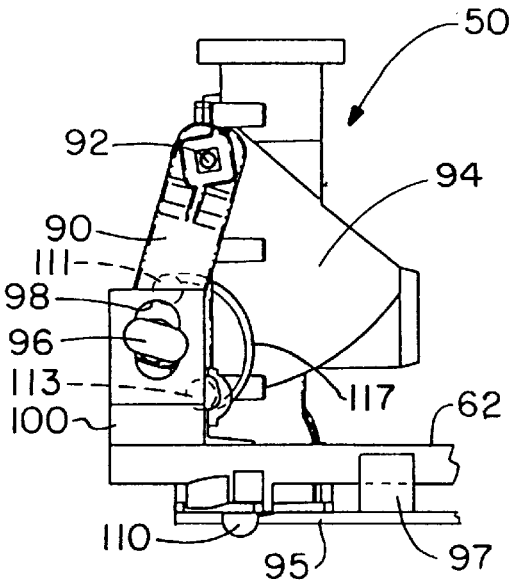

Referring now to FIGS. 7 and 8, the actuating rod 62 also actuates the main suction control valve 50 by way of a crank arm 90 fixed to a rotatable shaft 92 that is rotatably mounted in a main valve housing 94. The main valve housing is in turn mounted to a plate 95 which is affixed to the lower housing 16 (see FIGS. 1 and 2). A crank pin 96 extending from the crank arm 90 is slidingly received in a slot 98 in an upstanding portion 100 of the actuating rod 62. When the actuating rod is moved forward to its above floor mode position shown in FIG. 7 and FIG. 4, the actuating drives the crank arm forward via the crank pin and places the main suction control valve 50 in the above floor mode position shown in FIG. 7, in which it connects the suction hose 14 (see FIG. 3) and the upholstery nozzle 13 (see FIG. 1) to the recovery tank 7 and closes off the floor nozzle 22 from the recovery tank. On the other hand, when the actuating rod is moved rearward to its floor cleaning mode position shown in FIG. 8, the main suction control valve is moved to the floor cleaning mode position in which it connects the floor nozzle to the recovery tank and closes off the suction hose from the recovery tank. An open topped U-shaped actuating rod guide and support element 97 (see FIGS. 8 and 4) extends up from the plate 95 and supports and guides the actuating rod 62.

Figure 9:
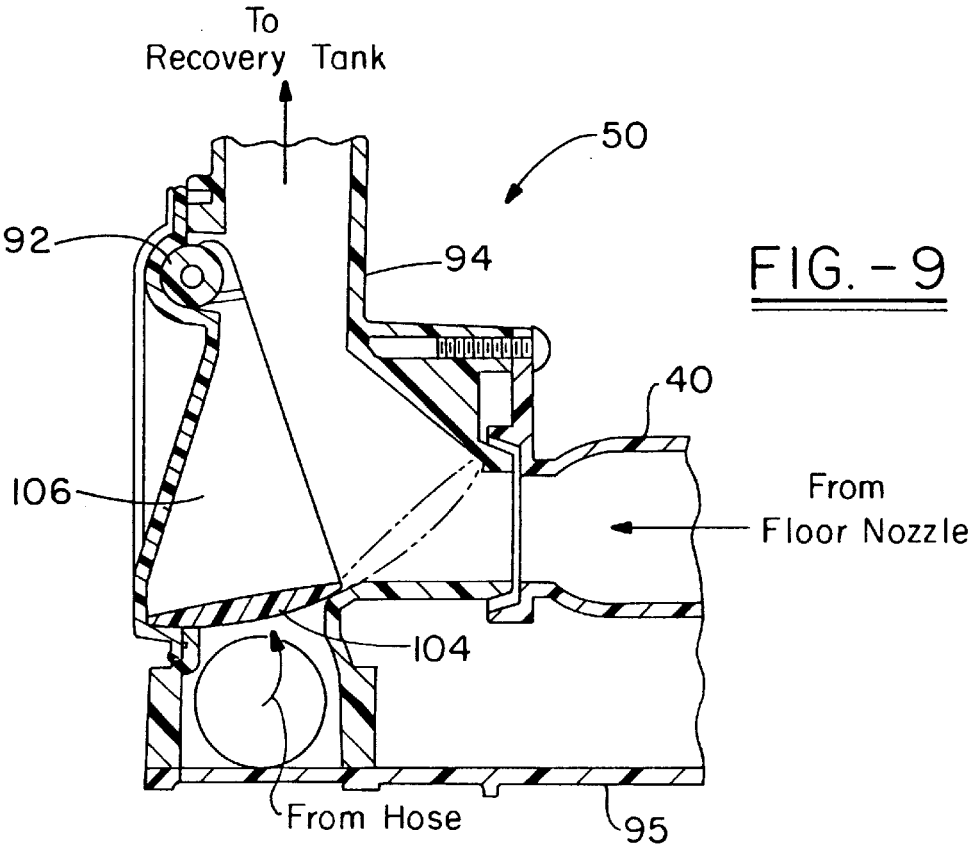
FIG. 9 is an explanatory cross-section of the main suction control valve.

Referring now to FIG. 9, the main suction control valve 50 preferably comprises a valve member 104 that is mounted to the rotatable shaft 92 by webs 106 (only one of which is shown) for pivotal motion in the valve housing 94 about an axis defined by the rotatable shaft 92. The valve member is pivotal between a floor cleaning mode position illustrated in solid lines and an above floor cleaning mode position illustrated in ghost. When in the floor mode position (solid lines), the valve member seals off the suction hose 14 from the recovery tank 7 and directs suction from the recovery tank to the floor nozzle 22. When in the above floor mode position (ghost lines), the valve member seals off the floor nozzle and directs the suction to the suction hose.

In operation, forward movement of the actuating rod 62 into the forward above floor cleaning mode position (as illustrated in FIGS. 4, and 7) automatically (i) actuates the link arm 72 to close the brush turbine throttle valve 54 (as shown in solid lines in FIG. 19) de-energizing the brush turbine 25, (ii) moves the slide valve 60 to open the pump turbine inlet opening 58 and energize the pump turbine 28 and (iii) actuates main suction control valve 50 to connect the above floor or upholstery nozzle 13 to the recovery tank 7 (as shown in ghost in FIG. 9). On the other hand, when the actuating rod is moved to its rearward floor cleaning mode position (as illustrated in FIGS. 5, and 8), the actuating rod automatically (i) moves the slide valve to block the pump turbine inlet opening 58 and de-energize the pump turbine and (ii) actuates the main suction control valve to connect the floor nozzle 22 to the recovery tank (as shown in solid lines in FIG. 9), while (iii) a spring 102 (see FIG. 14) assists in returning the bell crank 82 to its original, at rest position, thereby opening the brush turbine throttle valve (as shown in ghost in FIG. 19) energizing the brush turbine 25.

The distance that the actuating rod 62 is required to move to actuate the slide valve 60 and the main suction control valve 50 is greater than the distance required to activate the brush turbine throttle valve via the link arm 72. As a result, after the link arm and the brush turbine throttle valve 54 have returned to the open position, the actuating rod 62 must continue to move rearward in order to fully activate the main suction control valve 50 and the slide valve 60 and place the extractor 1 in the floor cleaning mode position illustrated in FIG. 5. As the actuating rod continues to move rearward to its floor cleaning mode position, the torsion spring 75 is engaged by a torsion spring retaining hook 85 extending from the link arm 72. The torsion spring retaining hook 85 holds the torsion spring in a pre-stressed position in which the torsion spring is disengaged from the leg 70 of the link arm when the actuating rod is in the floor cleaning mode position shown in FIG. 5. With this construction, the actuating rod can continue to move rearward after the brush turbine throttle valve is fully activated to its floor mode position, in order to finish activating the main suction control valve and the slide valve.

Referring now to FIGS. 10 through 13, in order to provide automatic conversion from the floor cleaning mode to the above floor cleaning mode and back again, depending on the operational position of the handle portion 2 of the upright carpet extractor 1, an actuation pin 110 is mounted to the handle portion 2 at a location spaced from the handle pivot axis defined by trunnions 108 (as illustrated in FIG. 4, which shows a horizontal cross-section of the handle portion 2 taken at the level of the action pin, i.e. above the trunnions along a horizontal plane substantially level with the actuating rod 62). The trunnions pivotally mount the handle portion 2 to the base module 4 as disclosed in the above mentioned commonly owned U.S. Pat. No. 5,500,977. The actuation pin 110 is preferably formed of metal and is preferably threaded into the handle portion 2. However, it will be appreciated that the actuation pin 110 my be mounted to the handle portion in any suitable fashion other than by threads and may be made of any suitable material. The actuation pin 110 is located on the handle portion 2 such that it engages a recess 112 in a lower surface of the actuating rod 62 adjacent to a rear end of the actuating rod 62 when the handle portion is in the upright storage position.

Figure 10:
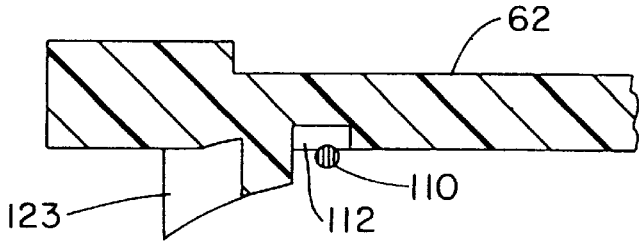
FIGS. 10 through 13 are explanatory partial views illustrating the engagement of the carpet extractor's handle portion with the automatic conversion mechanism.
Figure 11:
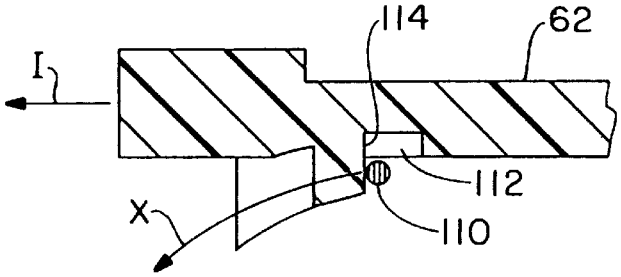
Figure 12:
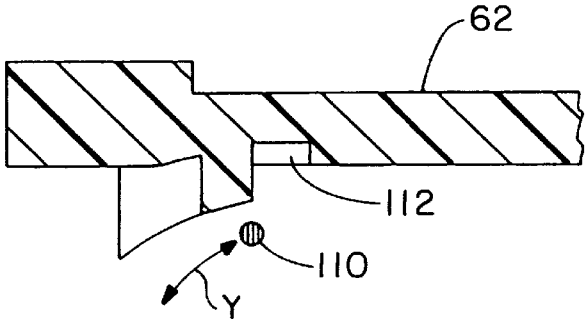

When the handle portion 2 is pivoted, as illustrated by an arrow X in FIG. 11, from the storage position shown in FIG. 10 to the operating position shown in FIG. 12, the actuation pin engages an inner rear wall or surface 114 of the recess 112 and pulls the actuating rod rearward, as illustrated by an arrow I in FIG. 11, into its rearward floor cleaning mode position. The operating position of the handle portion 2 shown in FIG. 12 is not a fixed angular position of the handle portion 2 relative the base frame 4. During operation in the floor cleaning mode, the handle portion pivots throughout a range of angular motion relative the base frame 2 as illustrated by an arrow Y in FIG. 12. In order to provide for free movement Y of the handle portion in the operating position, the actuation pin 110 is completely disengaged from the recess 112 when the handle portion 2 is in the operating position, as illustrated in FIG. 12.

Figure 13:
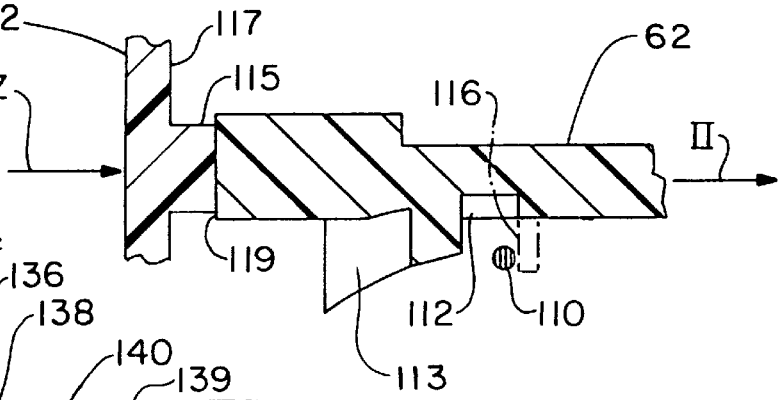

When the handle is pivoted from the operating position to its generally upright storage position, as indicated by an arrow Z in FIG. 13, an actuation bump 115 on an inner surface 117 of the handle portion 2 contacts a rear end surface 119 of the actuating rod 62 and pushes the actuating rod forward, as indicated by an arrow II in FIG. 13, into its above floor mode position. In an alternative embodiment, actuation bump 15 is removed from the handle portion 2 and the actuation pin 110 contacts an inner forward wall or surface 116 (illustrated in ghost) of the recess 112 and pushes the actuating rod forward into its forward, above floor mode position.

Surface 123 on the actuating rod 62 is preferably chamfered or inclined as shown ghost in FIG. 4. With this construction, if the actuating rod is accidentally moved forward to the above floor cleaning mode position illustrated in FIG. 10 when the handle 2 is in either the inclined operating position illustrated in FIG. 12 or in the generally horizontal recovery tank 7 removal position (not shown), and inner end 121 (shown in ghost in FIG. 4) of the actuation pin 110 will engage the chamfered surface 123 and be cammed into the recess 112 in the actuating rod 62 when the handle 2 is pivoted back to the storage position. If this surface was not chamfered, the actuation pin would catch on this surface in the above described situation, preventing the handle 2 from being returned to the storage position and/or possibly damaging the conversion mechanism.

Preferably, a conventional C-shaped off center spring 117 (as seen in FIG. 7) selectively positively biases the actuating rod 62 alternately into both the floor mode position and the above floor mode position to prevent accidental disengagement of the desired mode of operation. One end of the off center spring is preferably mounted to a pin 111 on the crank shaft 90 at a point spaced from the rotatable shaft 92, and the other end of the off center spring is mounted to a pin 113 on the main valve housing 94 at a location spaced further from the rotatable shaft 92 than the pin 111. A spring (not shown) may alternatively be mounted under tension between the actuating rod and a portion of the base module 4, such as the main suction control valve 50, that biases the actuating rod rearward into the floor mode position.

Figure 15:
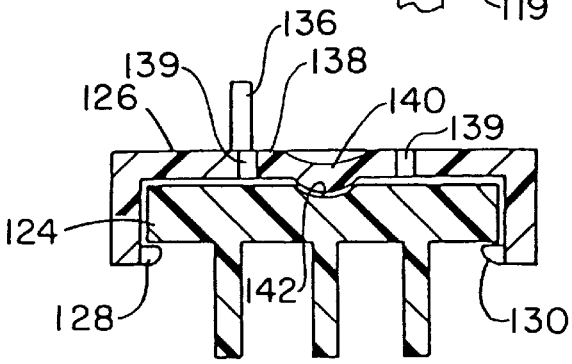
FIG. 15 is a cross-sectional view of the manual override mechanism taken along line 15—15 in FIG. 14.
Figure 14:
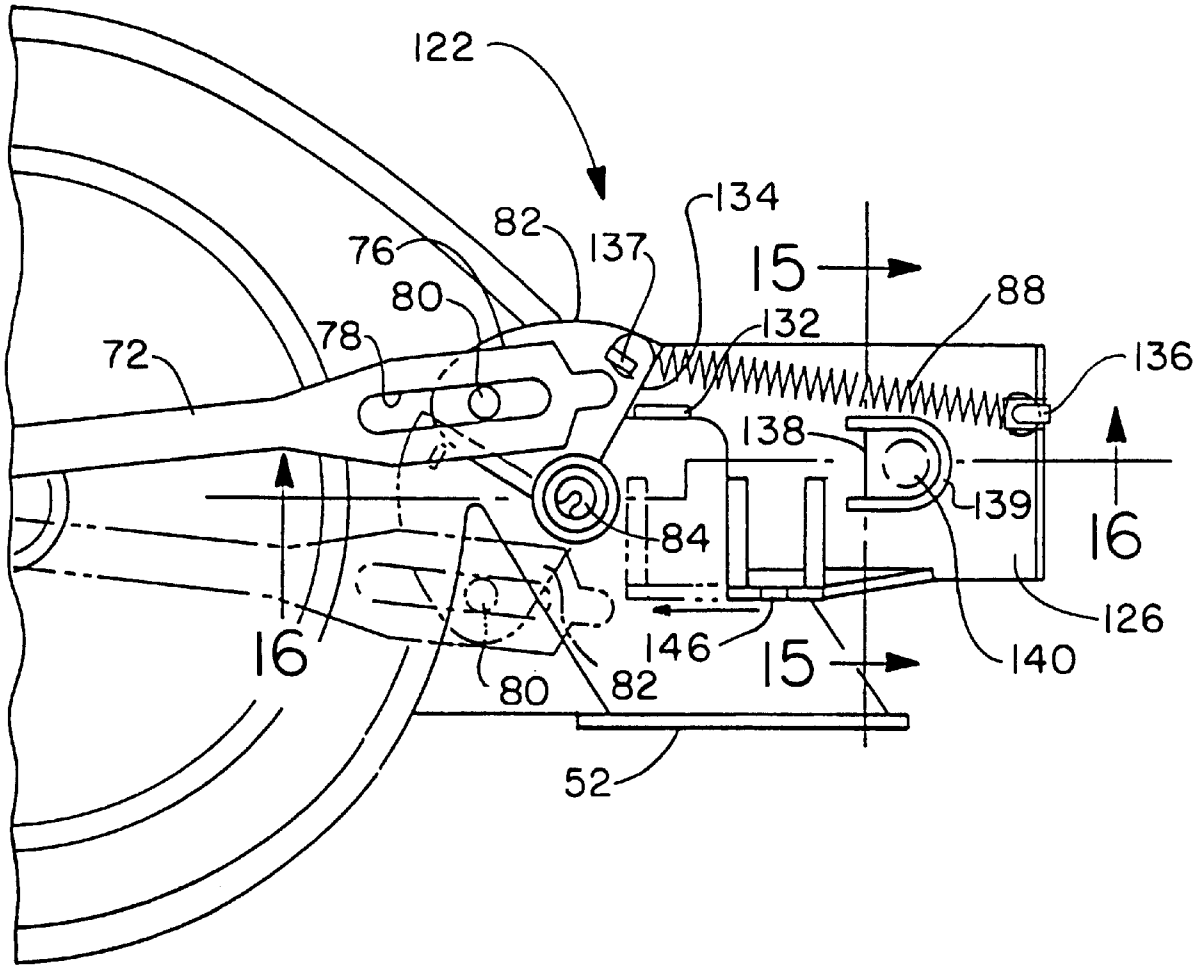
FIG. 14 is a partial top plan view illustrating the manual override mechanism on the brush turbine valve.

Referring now to FIGS. 14, 15 and 16, a manual override mechanism 122 is provided whereby the operator, when operating in the floor cleaning mode, may selectively close the throttle valve 54 and de-energizing the brush drive turbine 25 or select an intermediate position whereby the throttle valve 54 is partially closed thereby throttling the air flow through the brush turbine inlet conduit 52 causing the brush drive turbine 25 to rotate at a slower speed resulting in slower rotation of the brushes 26. The override mechanism comprises a table 124 (see FIGS. 15 and 16) that is preferably integrally molded to the brush drive turbine 25. However, it will be appreciated that the table may alternatively be attached to the brush turbine or to the lower housing 16. A slide 126 is slidingly attached to the table 124 by slide mounting tabs 128 and 130 (see FIG. 15). Projecting upward from the slide 126 is a bell actuating post 132. As the slide 126 is moved to the left by the operator via slide actuation tab 146 extending up from the slide (as viewed in FIG. 14) the bell actuating post 132 engages a flank side 134 of the bell crank 82, thereby rotating the bell crank and rotating the throttle valve 54 counterclockwise, closing the throttle valve (as shown in FIG. 16) and de-energizing the brush drive turbine 25. Upon return of the slide to its original position (as illustrated in FIG. 14) by the operator, the spring 102, which is mounted under tension between a spring mounting post 136 extending up from the table and a spring mounting post 137 on the bell crank, causes the bell crank to rotate clockwise, thereby rotating the throttle valve to the fully open position (shown in ghost in FIG. 18).

A U-shaped slot 139 passing through the slide 126 defines a cantilever tab 138 generally positioned along a lateral center line of the slide 126. The tab 138 has a bulbous boss 140 that alternately releasingly engages concavities 142 and 144 (as best seen in FIG. 16) in an upper surface of the table 124 in a releasable detent arrangement. The concavity 142 corresponds to the fully open position of throttle valve 54 and concavity 144 corresponds to the fully closed position of the throttle valve. A third concavity (not shown) may be provided that corresponds to an intermediate throttled position of the throttle valve. Thus, when operating in the floor cleaning mode, the operator may select the maximum turbine/brush speed, an intermediate turbine/brush speed or stop the brushes completely. Additional throttled positions may be added, if desired, by adding additional concavities providing additional brush speeds.

The slide actuation tab 146 extends upward through a suitable opening (not shown) in the upper housing 18 and a finger cup 148 (see FIG. 1) is snapped onto the top of the tab. The finger the cap 148 is received within a recess 150 in the upper housing when attached to the tab for easy access and actuation of the override mechanism by the operator.

Figure 19:
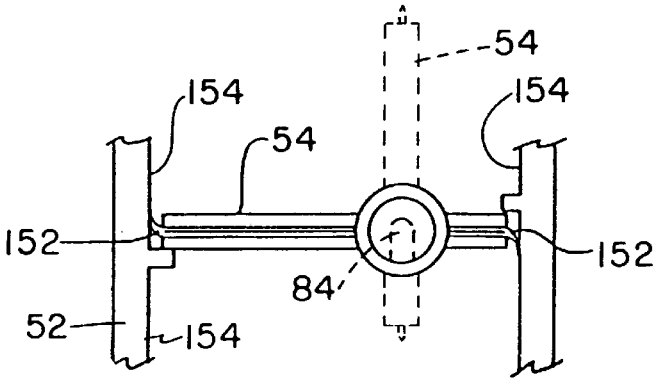
FIG. 19 is an explanatory top view of the brush turbine throttle

Referring now to FIGS. 17 through 19, in a preferred embodiment of the invention, the throttle valve 54 is a butterfly valve that is preferably non-symmetrical about the rotatable shaft 84. The throttle valve has an area 118 on one side of the shaft 84 that is greater than an area 120 on the other side of the rotatable shaft. With this construction, under the force of air flowing through the brush turbine inlet conduit 52, area 118 has a greater moment arm about the rotatable shaft than the smaller area 120. Thus, air flowing through to brush turbine inlet conduit creates a clockwise moment on the brush throttle valve that helps maintain the throttle valve in the fully open position and helps prevent valve flutter.

A peripheral edge of the throttle valve 54 preferably has a flexible lip seal 152 extending therefrom. The lip seal may be integrally molded with the throttle valve as an intentional "flash" of material around the door periphery. The "flash" of material preferably has a controlled thickness, such that the flash is flexible with respect to the door main body structure. Upon closing the throttle valve as illustrated in FIG. 19, the lip seal resiliently engages inside walls 154 of the brush turbine inlet conduit 52, thereby forming an air tight seal between the throttle valve and the brush turbine inlet conduit.

A strain relief (not shown) in the form of a split collar is preferably mounted on the suction hose 14 where the suction hose passes through the handle portion 2. The strain relief is in turn mounted to the handle portion. The suction hose is non-slidably clamped in the strain relief, so that when the operator is using the hand held wand 12, any tensile force created on the suction hose 14 is not transmitted to the main suction control valve 50. Any tensile force created by the operator on the suction hose will create an opposite force on the handle portion via the strain relief. Thus, the main suction control valve is protected from strain caused by the operator pulling on the suction hose. A sufficient length of suction hose is provided between the strain relief and the main suction control valve to prevent the hose from pulling on and straining the valve when the handle is pivoted through its full range of motion.

A cleaning mode indicator, in the form of one or preferably two windows 156 and 158, is preferably located on the upper housing of the base module above the actuating rod 62. A brightly colored, preferably raised portion 160 (shown in FIG. 4 only) on the actuating rod 62 is visible through a first 156 of the two windows when the carpet extractor is in the above floor cleaning mode and is visible through a second 158 of the two windows when the extractor is in the floor cleaning mode. The windows are preferably labeled with appropriate legends, for example "attached tools" and "floor nozzle", in order to provide a visual indication of the current operational mode of the extractor.

The above description of one preferred embodiment discloses air powered turbines 25 and 29 for driving the brushes 26 and for driving the pump 29. However, it will be appreciated that electric motors may alternatively be used in place of the turbines 25 and 29. In which case, the actuation mechanism would operatively activate appropriate switches for automatically energizing and de-energizing the motors when the handle is pivoted from the storage position to the operating position and back again, for placing the carpet extractor 1 in the desired cleaning mode. For example, the conversion mechanism may include one or more micro switches on one of the floor engaging section 4 or the handle 2 that is engaged by a pin, cam or other element on the other one of the floor engaging section and the handle for activating and de-activating the electric motors.

Upon reading the above description of one preferred embodiment of the present invention, it will become apparent to one of skill in the art that various modifications may be made to the disclosed preferred embodiment, without departing from the scope of the present invention as described by way of example above and as set forth in the appended claims.

We claim:

1. A carpet extractor comprising:

a) a floor engaging section having a floor nozzle and a driven agitator for cleaning a floor surface:

b) an upright handle pivotally connected to the floor engaging section for pivotal motion between a generally vertical storage position and an inclined operating position for directing the floor engaging section over a floor surface to be cleaned;

c) a hand held nozzle having a cleaning solution applicator attached thereto for above floor cleaning;

d) a cleaning solution distribution system including a pump for providing pressurized cleaning solution to the cleaning solution applicator;

e) an electric fan having a suction side and an exhaust side;

f) a suction control valve for selectively fluidly connecting the suction side of the fan alternately to the floor nozzle and to the hand held nozzle; and g) a conversion mechanism operatively connected to the pump, the driven agitator and the suction control valve and actuated by the handle, whereby:

i) when the handle is pivoted to the inclined operating position, the handle actuates the conversion mechanism, whereby the conversion mechanism activates the agitator and positions the suction control valve in a floor position in which the valve fluidly connects the suction side of the fan to the floor nozzle; and ii) when the handle is pivoted to the generally vertical storage position, the handle actuates the conversion mechanism, whereby the conversion mechanism activates the pump to provide pressurized cleaning solution to the solution applicator and positions the suction control valve in an above floor position in which the valve fluidly connects the suction side of the fan to the hand held nozzle.

2. An extractor according to claim 1, wherein the driven agitator further comprises an agitator motor for driving the agitator and the pump further comprises a pump motor for driving the pump; and wherein the conversion mechanism (i) energizes the agitator motor and de-energizes the pump motor when the handle is pivoted to the operating position, and (ii) de-energizes the agitator motor and energizes the pump motor when the handle is pivoted to the storage position.

3. An extractor according to claim 2, wherein the agitator motor comprises an air powered agitator turbine in fluid communication with the fan, whereby the fan selectively creates a flow of air through the agitator turbine for energizing the agitator turbine and activating the agitator.

4. An extractor according to claim 3, wherein the pump motor comprises an air powered pump turbine in fluid communication with the fan, whereby the fan selectively creates a flow of air through the pump turbine for energizing the pump turbine and activating the pump.

5. An extractor according to claim 4, further comprising an agitator valve located to selectively block the flow of air through the agitator turbine;

wherein the conversion mechanism is operatively connected to the agitator valve for (i) closing the agitator valve blocking the flow of air through the agitator turbine when the handle is pivoted to the storage position, and (ii) opening the agitator valve allowing air to flow through the agitator turbine when the handle is pivoted to the operating position.

6. An extractor according to claim 5, further comprising a pump valve located to selectively block the flow of air through the pump turbine;

wherein the conversion mechanism is operatively connected to the pump valve for (i) closing the pump valve blocking the flow of air through the pump turbine when the handle is pivoted to the operating position, and (ii) opening the pump valve allowing air to flow through the pump turbine when the handle is pivoted to the storage position.

7. An extractor according to claim 6, wherein the pump valve comprises a slide valve mounted for reciprocal movement between an open position and a closed position, and is operatively connected to the conversion mechanism.

8. An extractor according to claim 6, wherein the conversion mechanism comprises an actuating rod mounted on the extractor for reciprocal movement, the actuating rod being operatively connected to the pump valve and to the agitator valve for selectively energizing and de-energizing the pump and agitator turbines, the actuating rod also being operatively connected to the suction control valve for selectively positioning the suction control valve in the floor and above floor positions, the actuating rod being actuated by motion of the handle between the storage and operating positions.

9. An extractor according to claim 8, wherein the pump valve comprises a slide valve mounted for reciprocal motion between an open position and a closed position.

10. An extractor according to claim 9, wherein the slide valve is fixed to the actuating rod for reciprocal motion with the actuating rod.

11. An extractor according to claim 10, wherein the slide valve is integrally formed with the actuating rod.

12. An extractor according to claim 8, further comprising a link arm having a first end that is operatively connected to the agitator valve and a second end that is pivotally mounted to the extractor defining a pivot point; and the actuating rod is adapted to operatively engage the link arm at a location spaced from the pivot point when the handle is pivoted to the storage position, whereby the link arm is actuated for closing the agitator valve.

13. An extractor according to claim 12, further comprising a torsion spring having a first end mounted to the link arm and a second end that is located to be engaged by the actuating rod when the handle is pivoted to the storage position, whereby the actuating rod biases the second end of the torsion spring, such that the first end of the torsion spring applies a torque to the link arm, whereby the link arm is actuated for closing the agitator valve.

14. An extractor according to claim 13, wherein the first end of the torsion spring is coiled at least once around the pivot point and is hooked to the link arm at said location spaced from the pivot point and the second end of the torsion spring has a hook that engages the actuating rod.

15. An extractor according to claim 8, further comprising an actuation member on the handle spaced from a pivotal axis of the handle relative the floor engaging section;

a recess in a lower surface of the actuating rod adjacent a first end of the actuating rod, the recess having a generally vertical inner rear surface;

wherein the actuating rod is mounted on the floor engaging section for reciprocal movement and is located such that when the handle is pivoted from the storage position to the operating position, the actuation member engages the inner rear surface of the recess and pulls the actuating rod in a first direction into a floor mode position.

16. An extractor according to claim 15, wherein the recess further has a generally vertical inner forward surface located to be engaged by the actuation member when the handle is pivoted from the operating position to the storage position, whereby the actuation member pushes the actuating rod in a second direction, opposite the first direction, into an above floor mode position.

17. An extractor according to claim 8, wherein when the handle is pivoted from the operating position to the storage position, an inner surface of the handle abuts against a first end of the actuating rod and pushes the actuating rod into an above floor mode position.

18. An extractor according to claim 17, further comprising a spring operatively mounted under tension between the floor engaging section and the actuating rod for biasing the actuating rod into the floor mode position.

19. An extractor according to claim 8, further comprising an off-center spring operatively mounted between the floor engaging section and the actuating rod for selectively biasing the actuating rod alternately into the storage and operating positions.

20. An extractor according to claim 5, further comprising a link arm operatively connected to the agitator valve for selectively opening and closing the agitator valve, the link arm being actuated by the conversion mechanism when the handle is pivoted to the storage position for closing the agitator valve.

21. An extractor according to claim 20, further comprising:

a) a bell crank connected to the agitator valve such that rotation of the bell crank selectively opens and closes the agitator valve;

b) a spring connected to the bell crank for biasing the bell crank and the agitator valve toward the open position; and c) wherein the link arm is operably connected to the bell crank, such that upon actuation of the link arm by the actuating rod, the link arm rotates the bell crank and closes the agitator valve.

22. An extractor according to claim 21, further comprising:

a) a pin extending from the bell crank;

b) a first end of the link arm having a slot therein;

c) the pin being slidingly received in the slot.

23. An extractor according to claim 21, further comprising a manual override mechanism for selectively closing the agitator valve when the handle is in the operating position, said manual override mechanism comprises:

a) a table mounted on the extractor;

b) a slide slidingly engaging the table;

c) a cantilevered tab carried by the slide;

d) the table having at least two concavities configured to accept the cantilevered tab;

e) the cantilevered tab selectively engages the concavities to releasably retain the slide in at least two positions; and f) wherein the slide engages the bell crank at one of the least two positions for closing the agitator valve.

24. An extractor according to claim 5, wherein the conversion mechanism further comprises a manual override mechanism operatively connected to the agitator valve for selectively closing the agitator valve when the handle is in the operating position.

25. An extractor according to claim 3, further comprising an agitator valve operatively connected to and actuated by the conversion mechanism and located to selectively (i) block the flow of air through the agitator turbine when the handle is in the storage position and (ii) allow air to flow through the agitator turbine when the handle is in the operating position.

26. An extractor according to claim 25, wherein the agitator turbine has an agitator turbine inlet in fluid communication with ambient atmosphere and an agitator turbine outlet in fluid communication with the suction side of the fan.

27. An extractor according to claim 26, wherein the agitator valve is located to selectively block the agitator turbine inlet.

28. An extractor according to claim 2, wherein the pump motor comprises an air powered pump turbine in fluid communication with the fan, whereby the fan creates a flow of air through the pump turbine for energizing the pump turbine and activating the pump.

29. An extractor according to claim 28, further comprising a pump valve operatively connected to and actuated by the conversion mechanism and located to selectively (i) block the flow of air through the pump turbine when the handle is pivoted to the operating position, and (ii) allow air to flow through the pump turbine when the handle is pivoted to the storage position.

30. An extractor according to claim 29, wherein the pump turbine has a pump turbine outlet in fluid communication with the suction side of the fan and a pump turbine inlet in fluid communication with ambient atmosphere.

31. An extractor according to claim 30, wherein the pump valve is located to selectively block the pump turbine inlet.

32. An extractor according to claim 31, wherein the pump valve is a slide valve slidingly mounted on the pump turbine inlet, for reciprocal motion relative the pump turbine inlet, the slide valve having a window passing therethrough that is in line with the pump turbine inlet when the handle is in the storage position and a solid, continuous portion that blocks the pump turbine inlet when the handle is in the operating position.

33. An extractor according to claim 1, wherein the floor engaging section includes a cleaning solution distributor for selectively applying cleaning solution to a floor surface to be cleaned.

34. An extractor according to claim 33, further comprising a cleaning solution supply tank located higher off the floor than the cleaning solution distributor, whereby cleaning solution is selectively supplied from the supply tank to the solution distributor under the force of gravity.

35. An extractor according to claim 33, wherein the pump is activated when the handle is in the operating position for providing pressurized cleaning solution to the cleaning solution distributor.

36. A carpet extractor comprising:

a) a floor engaging section having a cleaning solution distributor and a floor nozzle for cleaning a floor surface;

b) a generally upright handle pivotally connected to the floor engaging section for pivotal movement between a generally upright storage position and an inclined operating position;

c) a hand held nozzle having a cleaning solution applicator attached thereto for above floor cleaning;

d) a cleaning solution distribution system including a cleaning solution supply pump for providing a source of pressurized cleaning solution;

e) suction producing means;

f) a control valve for selectively fluidly connecting the suction producing means alternately to the floor nozzle in a floor position and to the hand held nozzle in an above floor position; and g) a conversion mechanism that is operatively connected to the control valve, operatively connected to the cleaning solution distribution system and activated by the handle, whereby:

i) when the handle is in the storage position, the conversion mechanism positions the control valve to fluidly connect the hand held nozzle to the suction producing means and activates the distribution system to provide pressurized cleaning solution to the solution applicator; and ii) when the handle is in the operating position, the conversion mechanism positions the control valve to fluidly connect the floor nozzle to the suction producing means.

37. An extractor according to claim 36, wherein the cleaning solution supply pump is driven by an air powered pump turbine in fluid communication with the suction producing means, whereby the suction producing means creates a flow of air through the pump turbine for energizing the pump turbine and activating the pump.

38. An extractor according to claim 37, further comprising a pump valve located to selectively block the flow of air through the pump turbine; and wherein the pump valve is operatively connected to the conversion mechanism, whereby the pump valve is closed blocking the flow of air through the pump turbine when the handle is pivoted to the operating position and opened allowing air to flow through the pump turbine when the handle is pivoted to the storage position.

39. An extractor according to claim 38, wherein the pump turbine has an outlet in fluid communication with the suction producing means and an inlet in fluid communication with the external atmosphere.

40. An extractor according to claim 39, wherein the pump valve is located on the pump turbine inlet.

41. An extractor according to claim 40, wherein the pump valve is a slide valve slidingly mounted on the pump turbine inlet, for reciprocal motion relative the pump turbine inlet, the slide valve having a window passing therethrough that is in line with the pump turbine inlet when the handle is in the storage position and a solid, continuous portion that blocks the pump turbine inlet when the handle is in the operating position.

42. An extractor according to claim 41, wherein the conversion mechanism comprises an actuating rod, the actuating rod being operatively connected to the slide valve for selectively energizing and de-energizing the pump, the actuating rod also being operatively connected to the control valve for selectively positioning the control valve in the floor and above floor positions.

43. An extractor according to claim 42, wherein the slide valve is integrally formed with the actuating rod.

44. An extractor according to claim 42, further comprising an actuation member on the handle spaced from a pivotal axis of the handle relative the floor engaging section;

a recess in a lower surface of the actuating rod adjacent a first end of the actuating rod, the recess having a generally vertical inner rear surface;

wherein the actuating rod is mounted on the floor engaging section for reciprocal motion relative the floor engaging section and the actuation member and the recess are arranged whereby, when the handle is pivoted from the storage position to the operating position, the actuation member engages the inner rear surface of the recess and pulls the actuating rod in a first direction into a floor mode position.

45. An extractor according to claim 44, wherein the recess further has a generally vertical inner forward surface located to be engaged by the actuation member when the handle is pivoted from the operating position to the storage position, whereby the actuation member pushes the actuating rod in a second direction, opposite the first direction, into an above floor mode position.

46. An extractor according to claim 45, further comprising an off-center spring operatively mounted between the floor engaging section and the actuating rod for selectively biasing the actuating rod alternately into the storage and operating positions.

47. An extractor according to claim 42, wherein when the handle is pivoted from the operating position to the storage position, an inner surface of the handle abuts against a first end of the actuating rod and pushes the actuating rod into an above floor mode position.

48. An extractor according to claim 47, further comprising a spring operatively mounted under tension between the floor engaging section and the actuating rod for biasing the actuating rod in a first direction into the floor mode position.

49. An extractor according to claim 36, further comprising a cleaning solution supply tank located higher off the floor than the cleaning solution distributor, whereby cleaning solution is selectively supplied from the supply tank to the solution distributor under the force of gravity.

50. An extractor according to claim 36, wherein the pump is activated when the handle is in the operating position for providing pressurized cleaning solution to the cleaning solution distributor.

51. A carpet extractor having a motor/fan assembly, a power driven brush system for scrubbing a floor surface to be cleaned and a handle pivotally connected to the extractor for propelling the extractor over a floor surface, wherein the improvement comprises:

a) an air driven brush turbine in fluid communication with the motor/fan assembly and drivingly connected to the brush system, whereby the brush turbine is selectively energized by the motor/fan assembly for driving the brush system in a floor cleaning mode;

b) a cleaning solution pump and an air driven pump turbine in fluid communication with the motor/fan assembly and drivingly connected to the pump, whereby the pump turbine is selectively energized by the motor/fan assembly for driving the pump and providing a source of pressurized cleaning solution in an above floor cleaning mode; and c) a conversion mechanism for (i) energizing the brush turbine and de-energizing the pump turbine, when the handle is inclined to an operating position placing the extractor in the floor cleaning mode, and (ii) de-energizing the brush turbine and energizing the pump turbine, when the handle is placed in its generally upright storage position placing the extractor in the above floor cleaning mode.

52. An extractor according to claim 51, further comprising:

a) a brush valve that is selectively actuated between (i) an open position allowing the motor/fan assembly to cause air to flow through the brush turbine, thereby energizing the brush turbine, and (ii) a closed position blocking the flow of air through the brush turbine, thereby de-energizing the brush turbine;

b) a pump valve that is selectively actuated between (i) an open position allowing the motor/fan assembly to cause air to flow through the pump turbine, thereby energizing the pump turbine, and (ii) a closed position blocking the flow of air through the pump turbine, thereby de-energizing the pump turbine; and c) wherein the conversion mechanism operably engages the brush valve and the pump valve and is activated by the handle, whereby (i) when the handle is inclined to the operating position the handle actuates the conversion mechanism for opening the brush valve and closing the pump valve and (ii) when the handle is placed in the storage position the handle actuates the mechanism for closing the brush valve and opening the pump valve.

53. An extractor according to claim 52, further comprising a manual override mechanism operably connected to the brush valve for selectively closing the brush valve when the extractor is in the floor cleaning mode.

54. An extractor according to claim 52, wherein the conversion mechanism comprises an actuating rod mounted on the extractor for reciprocal motion relative the extractor, a first end of the actuating rod operably engages the brush valve and the pump valve and a second end of the actuating rod operably engages the handle, whereby pivotal motion of the handle to the operating position causes the actuating rod to move in a first direction to a floor cleaning mode position, and pivotal motion of the handle to the storage position causes the actuating rod to move in a second direction, opposite the first direction, to an above floor cleaning mode position.

55. The extractor according to claim 52, wherein the conversion mechanism comprises a link arm operatively connected to the brush valve, the link arm being positioned to be actuated by the conversion mechanism when the handle is pivoted into the storage position, whereby the link arm closes the brush valve.

56. A carpet extractor according to claim 51, further comprising a floor engaging floor nozzle in fluid communication with the motor/fan assembly via a main suction duct;

a hand held tool including an above floor nozzle in fluid communication with the main suction duct;

a main suction valve located in the main suction duct for selectively fluidly communicating the motor/fan assembly alternately with the floor nozzle and the above floor nozzle; and wherein the conversion mechanism is operatively connected to the main suction valve for activating the main suction valve to (i) fluidly communicate the floor nozzle with the motor/fan assembly in the floor cleaning mode and (ii) fluidly communicate the above floor nozzle with the motor/fan assembly in the above floor cleaning mode.

57. An extractor according to claim 56, wherein the hand held tool further comprises a spray head in fluid communication with the pump for selectively spraying cleaning solution on an above floor surface to be cleaned when in the above floor cleaning mode.

58. An extractor according to claim 51, further comprising a machine housing mounted to the extractor that encloses the brush turbine and the pump turbine, at least one indicator window passing through the machine housing and an indicator located in the machine housing and actuated by the actuator to be visible through the at least one indicator window when the extractor is in one of the floor and above floor cleaning modes to provide a visual indication of the current operational mode of the extractor.

* * * * *